US006386534B1

(12) United States Patent
Woody et al.

(10) Patent No.: US 6,386,534 B1
(45) Date of Patent: May 14, 2002

(54) APPARATUS FOR AND METHOD OF STACKING ARTICLES

(75) Inventors: Clark Woody, Pinconning; Stephen Gangler, Unionville; Jeffrey Hoffman, Linwood, all of MI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 09/521,425

(22) Filed: Mar. 8, 2000

(51) Int. Cl.[7] ..... B65H 31/10

(52) U.S. Cl. ..... 271/217; 271/219; 271/213; 414/792.7

(58) Field of Search ..... 414/792.7; 271/148, 271/217, 218, 219, 213

(56) References Cited

U.S. PATENT DOCUMENTS

| | | | | | |
|---|---|---|---|---|---|
| 1,685,799 | A | * | 10/1928 | Baker | 271/148 |
| 2,731,159 | A | | 1/1956 | Donehower | 214/6 |
| 3,567,216 | A | * | 3/1971 | Zeller | 271/148 |
| 3,578,181 | A | | 5/1971 | Hughes et al. | 214/6 |
| 3,908,985 | A | | 9/1975 | Wiseman | 271/189 |
| 4,103,785 | A | | 8/1978 | Wiseman | 214/6.5 |
| 4,396,379 | A | | 8/1983 | White et al. | 493/194 |
| 4,588,070 | A | | 5/1986 | Smith | 198/468.3 |
| 4,768,773 | A | | 9/1988 | Mall et al. | 271/299 |
| 4,942,435 | A | * | 7/1990 | Kneijel et al. | 271/148 |
| 5,302,080 | A | | 4/1994 | Smith et al. | 414/788.2 |
| 5,364,087 | A | * | 11/1994 | Schieck et al. | 271/148 |
| 5,511,773 | A | * | 4/1996 | Burger | 271/148 |
| 6,283,469 | B1 | * | 9/2001 | Weber | 271/148 |

* cited by examiner

*Primary Examiner*—H. Grant Skaggs

(57) ABSTRACT

An apparatus for and method of stacking flexible articles of a non-uniform thickness involves the use of a stacking table including separately movable first and second support surfaces. An actuator moves the stacking table through a range of motion relative to a stationary cam plate. A cam follower is mechanically coupled to the second support surface and engages the cam surface when the stacking table is moved through at least part of the range of motion. When the actuator moves the stacking table and the cam follower engages the cam surface, the second surface is displaced relative to the first support surface. Preferably, the cam plate is repositionable to vary a distance by which the second support surface is displaced relative to the first support surface.

54 Claims, 4 Drawing Sheets

APPARATUS FOR AND METHOD OF STACKING ARTICLES

BACKGROUND OF THE INVENTION

1. Field of the Invention

The present invention relates generally to an apparatus for and method of stacking articles, and in particular to an apparatus for and method of stacking flexible articles of non-uniform thickness while maintaining the uppermost article in a substantially horizontal orientation.

2. Description of the Related Art

In the final stages of production of flexible articles such as, for example, plastic zipper or slider bags, an orbital packer or similar device delivers the bags to a delivery point where they are stacked in preparation for packaging. At the delivery point, the first few bags of a stack typically are received on retractable count fingers while the previous stack is being removed from a stacking table, which is itself typically comprised of a plurality of fingers. Thereafter, the count fingers pass through the stacking table, depositing the first few bags of the new stack on the stacking table. Once a predetermined quantity of bags has been stacked on the stacking table, typically twenty-five, the count fingers again are deployed to separate the stack just formed from the continuous stream of bags, allowing removal of the stack while the next several bags begin forming a new stack on the count fingers. The process then repeats for each subsequent stack. The stacks formed on the stacking table are removed by a horizontal transfer mechanism, such as that disclosed in U.S. Pat. No. 4,588,070.

It is difficult to efficiently and neatly stack articles such as plastic bags using commercial, high-speed stacking machinery. This is due to the flexibility of these articles and their slippery surfaces (which aid in extrusion and film formation processes). If the bags are of non-uniform thickness, as they often are, stacking is even more difficult. For example, zipper bags have mating zipper elements along just one edge of the bag. A typical stack of twenty-five plastic zipper bags may be 2.0 inches or more thick at the zippered end (twenty-five times the thickness of the opposing pair of zipper elements), while being only 0.10 to 0.20 inches thick at the opposite end (twenty-five times the two-ply bag film thickness). If sliders are employed on the zippered end, the thickness differential is even greater. In the stacking of such bags, the uppermost bags in a stack are frequently disturbed by subsequent bags being deposited onto the stack. The slope created by the non-uniform thickness of the bags, coupled with the impact of subsequent bags being stacked, typically causes the uppermost bags to slide down the stack toward the end opposite to the zipper, resulting in shingled, rather than stacked, bags.

U.S. Pat. No. 5,302,080, assigned to the same assignee as the present invention and incorporated herein by reference in its entirety, discloses a stacking apparatus designed to alleviate some of the above-noted problems. The apparatus includes means for supporting the bags which moves downward as bags are stacked thereon so that the uppermost bag in a stack is maintained at a substantially constant height. In one embodiment, the means for supporting the bags is tilted as subsequent bags are deposited on the stack, thus maintaining the uppermost bag in a substantially horizontal orientation. In another embodiment, first and second supporting means cooperate to accomplish this same result. The first supporting means, on which the non-zippered portions of the bags rest, is maintained in a generally horizontal orientation as it moves downward. The second supporting means, on which the zippered portions of the bags rest, moves downward relative to the first supporting means. In each embodiment, a pair of cams is commonly supported on and rotatable with a drive shaft to regulate the overall downward movement of the supporting means, as well as the tilting of the supporting means or the movement of the second supporting means relative to the first supporting means. While this apparatus has been useful in overcoming some of the above-noted problems with the stacking of flexible articles of non-uniform thickness, its construction is relatively complex. Moreover, because the cams that regulate movement of the supporting means are affixed to a drive shaft, the relative movement of one portion of the supporting means relative to another portion thereof cannot be adjusted without shutting down the apparatus and replacing one or more parts. Consequently, there is no way to make adjustments to the apparatus while it is operating. In addition, the apparatus is not readily adaptable for switching between bags having different thicknesses or bags employing different closure mechanisms, or for forming stacks consisting of a different number of bags.

Accordingly, there is a need in the art for a simplified apparatus for and method of stacking articles of non-uniform thickness in neat stacks by maintaining the uppermost article in a substantially horizontal orientation and at a substantially constant height.

There is a further need for such an apparatus and method wherein opposite ends of a stacking table can descend by different amounts, and the difference can be adjusted without having to replace any parts of the apparatus.

There is a still further need for such an apparatus and method wherein the difference in amount of descent of opposite ends of a stacking table can be adjusted even while the apparatus is operating.

SUMMARY OF THE INVENTION

The present invention addresses the foregoing needs in the art by providing an apparatus for and method of stacking articles, in which separate support surfaces descend by different amounts, and the difference is readily adjustable.

In a first aspect of the present invention, a stacking apparatus includes a stacking table for receiving a plurality of articles. The stacking table includes separately movable first and second portions. The apparatus further includes means for moving the stacking table through a range of motion, means for displacing the second portion of the stacking table relative to the first portion of the stacking table as the stacking table is moved through the range of motion, and means for adjusting a relative distance by which the displacing means displaces the second portion of the stacking table relative to the first portion of the stacking table.

In another aspect, a stacking apparatus includes a stacking table for receiving a plurality of articles. The stacking table includes separately movable first and second portions. The apparatus further includes means for moving the stacking table through a range of motion, and means for displacing the second portion of the stacking table relative to the first portion of the stacking table in response to movement of the stacking table through the range of motion by the moving means.

In yet another aspect, a stacking apparatus includes a stacking table having separately movable first and second support surfaces, a selectively stationary cam plate having a cam surface, and an actuator for moving the stacking table through a range of motion relative to the cam plate. A cam follower is mechanically coupled to the second support surface and located to engage the cam surface when the stacking table is moved go through at least part of the range of motion, so that when the actuator moves the stacking table and the cam follower engages the cam surface, the second support surface is displaced relative to the first support surface.

In still another aspect, a stacking method involves delivering a plurality of articles sequentially at a delivery height to a stacking table having a first support surface and a second support surface. The stacking table is lowered relative to the delivery height so that each subsequent article delivered to the stacking table is stacked on top of a previous article at substantially the delivery height. Simultaneously with this lowering step and responsive to the lowering of the stacking table, the second support surface is displaced downward relative to the first support surface.

In a further aspect, an apparatus for stacking sequentially a plurality of articles, each having a relatively thin portion and a relatively thick portion, includes a stacking table for receiving the plurality of articles. The stacking table has a first support surface for supporting the relatively thin portion of the articles and a second support surface for supporting the relatively thick portion of the articles. The apparatus further includes a cam plate having a cam surface, an actuator coupled to the stacking table for moving the stacking table through a range of motion relative to the cam plate, and a lever pivotally mounted relative to the stacking table and linked to the second support surface. A cam follower is connected to the lever so that as the stacking table is moved through at least part of the range of motion, the cam follower engages the cam surface, thereby pivoting the lever to displace the second support surface relative to the first support surface.

In a still further aspect, a stacking method involves delivering a continuous stream of articles sequentially to a stacking table at a delivery height. Each article has a relatively thin portion and a relatively thick portion. The stacking table to which the articles are delivered includes a first support surface for supporting the relatively thin portion of the articles and a second support surface for supporting the relatively thick portion of the articles. The second support surface is biased upward into horizontal alignment with the first support surface by a spring. The method further involves lowering the stacking table relative to the delivery height, so that each subsequent article is stacked on top of a previous article at substantially the delivery height, and downwardly displacing the second support surface a vertical distance relative to the first support surface against the upward biasing of the spring, such that the uppermost article in the stack is maintained in a substantially horizontal orientation.

In another aspect, a stacking apparatus includes a stacking table for receiving a plurality of flexible articles, each having a non-uniform thickness. The stacking table includes separately movable first and second support surfaces. The apparatus further includes a frame on which the first support surface is mounted, an elongated reciprocating member coupled to the second support surface, a spring for biasing the second support surface upward relative to the frame, and a lever having two arms disposed at an angle relative to one another. The lever is pivotally coupled to the frame near an intersection of the two arms of the lever, and has a cam follower mounted on one arm thereof. At the other arm, the lever is pivotally coupled to the reciprocating member. The apparatus also includes a selectively stationary cam plate having a cam surface for engagement with the cam follower, and an actuator coupled to the stacking table for moving the stacking table downward relative to the cam plate. As the actuator moves the stacking table downward, the cam follower engages the cam surface, causing the lever to pivot so as to displace the second support surface downward relative to the first support surface against the upward biasing of the spring.

A better understanding of these and other objects, features, and advantages of the present invention may be had by reference to the drawings and to the accompanying description, in which there are illustrated and described preferred embodiments of the invention.

BRIEF DESCRIPTION OF THE DRAWINGS

Throughout the figures, like or similar reference numerals have been used for like or corresponding parts.

DESCRIPTION OF THE PREFERRED EMBODIMENTS

For illustrative purposes, the preferred embodiment of a stacking apparatus according to the present invention is described in connection with the stacking of plastic zipper bags. The present invention, however, can be utilized in the stacking of many types of articles, but is particularly well-suited for the stacking of flexible articles of non-uniform thickness, such as plastic zipper bags or slider bags.

The stacking apparatus of the present invention is an improvement over those disclosed in U.S. Pat. No. 5,302,080, discussed above.

Figure 1:
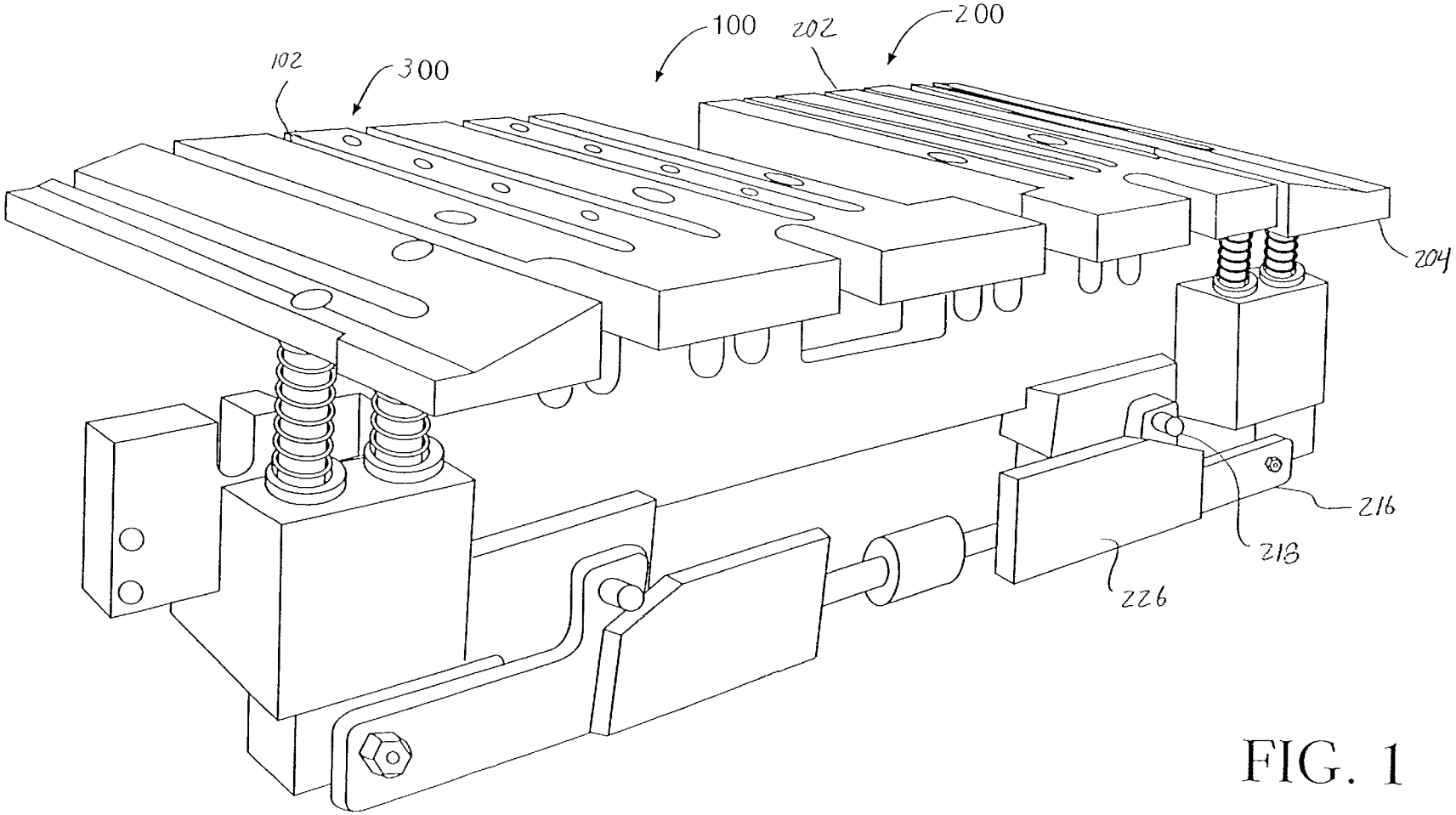
FIG. 1 is a perspective view of a preferred embodiment of a stacking apparatus according to the present invention.

Referring to FIG. 1, a preferred embodiment of a stacking apparatus according to the present invention is designated generally by reference numeral 100. The stacking apparatus shown in FIG. 1 is designed for use in a dual lane bag-making apparatus. The stacking apparatus comprises a pair of adjacent stacking tables 200 and 300, each of which receives bags from an orbital packer (not shown) to form a stack thereon. The stacking apparatus of the present invention can be easily adapted for use in single lane or other multiple lane bag-making apparatuses.

Each stacking table mirrors the other in terms of construction and operation. Therefore, the present invention will be described below with reference to one stacking table 200.

The stacking table 200 includes separately movable first and second support surfaces 202, 204. In the preferred embodiment shown, the first support surface 202 is approximately two to three times larger in surface area than the second support surface 204. The first and second support surfaces 202, 204 cooperatively receive and support bags delivered to the stacking apparatus 100 from an orbital packer, for example. The relatively thin portions of the bags rest on the first support surface 202, while the relatively thick portions of the bags (e.g., the closured or zippered end) rest on the second support surface 204. As described below, the second support surface 204 can be displaced vertically relative to the first support surface 202 to maintain the uppermost bag in a stack in a substantially horizontal orientation. Additionally, the second support surface 204 may be contoured to follow generally the profile of the zippered end of the bags to help meet this objective.

As best shown in FIG. 1, the preferred stacking table 200 has a plurality of slots 102 formed therein so that count fingers (not shown) can pass freely through the stacking table 200.

Figure 2:
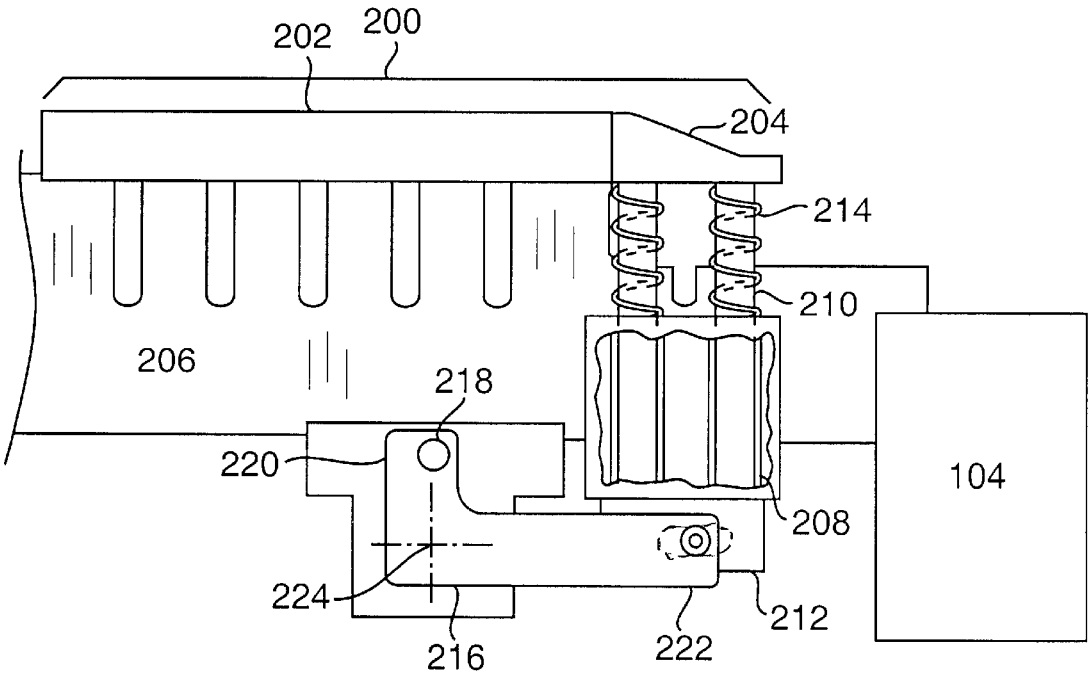
FIG. 2 is a schematic, partial cut-away elevational view of a portion of the stacking apparatus shown in FIG. 1, wherein cam plates are not shown.

Turning to FIG. 2, the second support surface 204 is mounted such that it can vertically reciprocate relative to the-first support surface 202. The second support surface 204 is biased upward into horizontal alignment with the first support surface 202, but is impeded from rising above the level of first support surface 202.

In the embodiment shown, the first support surface 202 is formed with or mounted on a frame 206, using bolts or any other suitable means for mounting. The frame 206 has a pair of vertical bores 208 formed therethrough. The second support surface 204 is supported by a pair of elongated reciprocating members 210, which, in a preferred embodiment, are cylindrical rods. An upper end of each reciprocating member 210 extends from or is connected to the underside of the second support surface 204. Each reciprocating member 210 extends through a respective bore 208 in the frame 206 and is connected at its lower end to a pivot block 212. In the preferred embodiment shown, two reciprocating members 210 are employed; however, fewer or more could just as effectively be used.

A compression spring 214 is disposed about each reciprocating member between the underside of the second support surface 204 and an upwardly facing surface of the frame 206. The springs 214 bias the second support surface 204 upward into horizontal alignment with the first support surface 202. When the second support surface 204 is horizontally aligned with the first support surface 202, the pivot block 212 abuts the underside of the frame 206. This limits the relative movement of the second support surface 204 in the upward direction, ensuring that the second support surface 204 does not exceed the level of the first support surface 202.

A multi-arm lever 216 is used to reciprocate the second support surface 204 relative to the first support surface 202. The lever 216 is pivotally coupled to the first support surface 202 near a junction of the arms. One arm of the lever 216 includes a cam follower 218 (the function of which will be discussed below).

Another arm of the lever 216 is pivotally coupled to the second support surface 204.

In the preferred embodiment, the lever 216 is substantially L-shaped. The lever 216 has two arms 220, 222 and, near the intersection of the arms 220, 222, is pivotally connected to a side portion of the frame 206 at a point 224. The cam follower 218 extends from or is mounted to one lever arm 220. Preferably, the cam follower 218 is made of steel and is rotatably mounted to the lever 216. The other lever arm 222 is pivotally connected to the pivot block 212 (and is, therefore, coupled to the second support surface 204).

As best illustrated in FIG. 2, the second support surface 204 is mechanically coupled to the cam follower 218 via the reciprocating members 210, the pivot block 212, and the lever 216. As such, movement of the cam follower 218 causes movement of the second support surface 204, and vice versa. Many variations of the particular arrangement shown are possible without departing from the scope of the invention, as will be appreciated by those of ordinary skill in the art. As one example, a substantially L-shaped lever could be pivotally connected at a junction of its arms directly to a first table, with one arm being pivotally connected directly to a second table.

The frame 206, including all parts connected in one way or another thereto, is movable vertically through a range of motion by any conventional means, so that each subsequent bag is stacked on top of a previous bag at a substantially constant height relative to a fixed point of reference. Means for moving the frame 206 can include, for example, an actuator 104. Suitable actuators include linear actuators, cam assemblies, piston assemblies, and any other suitable means for moving the frame 206 through a range of motion.

As the frame 206 and the first and second support surfaces 202, 204 move downward, the cam follower 218 contacts a stationary contact surface. The interaction of the cam follower 218 with this surface forces the lever 216 to pivot about point 224 relative to the first support surface 202, pulling the second support surface 204 downward against the upward biasing of the spring 214.

Figure 3:
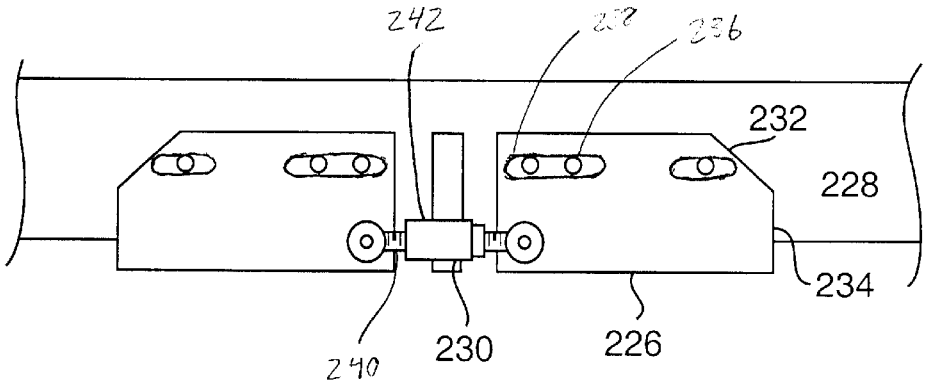
FIG. 3 is a schematic elevational view of a cross bar for use in the stacking apparatus shown in FIG. 1.

As best seen in FIG. 3, the contact surface (which the cam follower 218 contacts) is provided on a cam plate 226 that adjustably mounted on a cross bar 228 using a plurality of shoulder bolts 236. The shoulder bolts 236 are received in slots 238 in cam plate 226. The cam plate 226 and the cross bar 228 preferably are constructed of steel. The cross bar 228 is rigidly held in place in the stacking apparatus 100, so that the frame 206 moves up and down relative to the cross bar 228.

The cam plate 226 can be repositioned (preferably horizontally) on the cross bar 228, such as shown in FIG. 3. This adjustment can be accomplished manually by using an adjustable screw assembly 230 or the like. A preferred adjustable screw assembly comprises a pair of left- and right-hand threaded screws 240, extending in opposite directions from a rotatable sleeve 242. Unless the cam plate 226 is manually repositioned, however, it remains stationary.

The cam plate 226 has a cam surface 232 for selective engagement by the cam follower 218. In a preferred embodiment as shown in FIG. 3, the cam surface 232 is sloped relative to the direction of movement of the frame 206. The purpose of this slope will be made apparent below.

Figure 4:
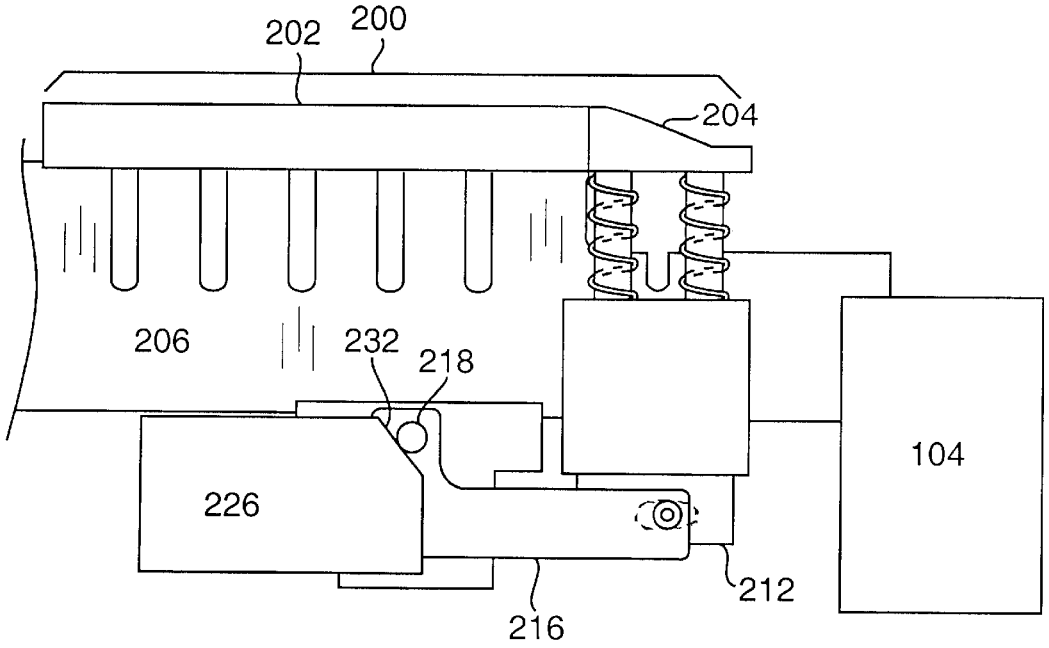
FIG. 4 is a schematic elevational view of the portion of the stacking apparatus shown in FIG. 1, wherein one cam plate is also illustrated and support surfaces of a stacking table are horizontally aligned.
Figure 5:
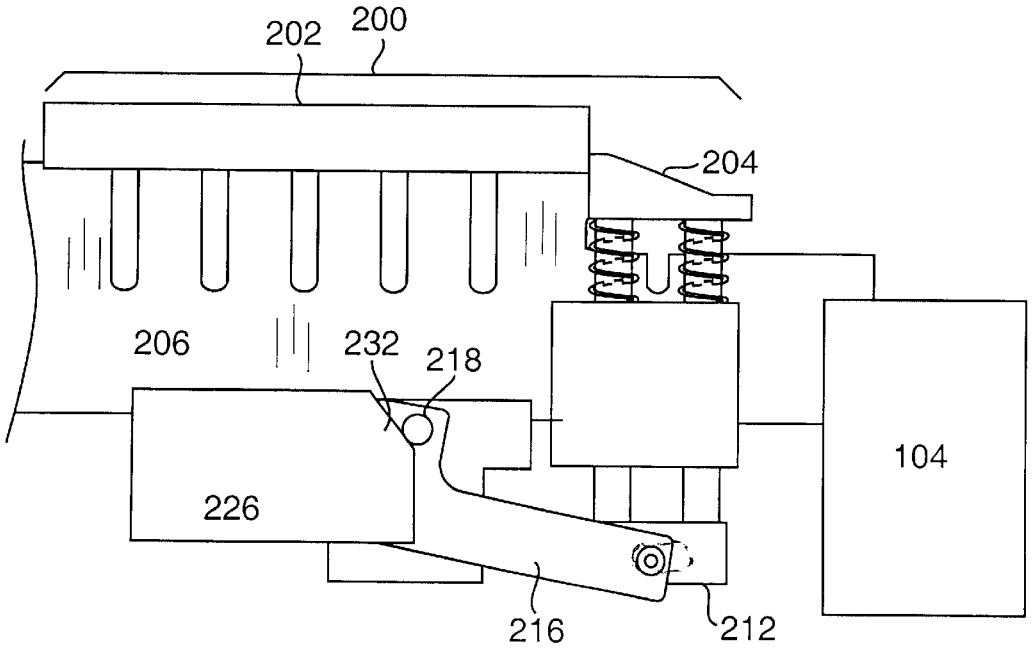
FIG. 5 is a schematic elevational view of the portion of the stacking apparatus shown in FIG. 4, wherein the support surfaces of the stacking table are displaced relative to one another.

The operation of the above-described stacking apparatus 100 will now be discussed with particular reference to FIGS. 4 and 5, wherein one half of the stacking apparatus 100 depicted in FIG. 1 is shown. For purposes of illustration, the cross bar 228 is not shown in FIGS. 4 and 5, although the cam plate 226 is shown.

Typically, an orbital packer delivers bags one by one to a stacking table 200 at a predetermined delivery height. As the bags are stacked on the stacking table 200, the actuator 104 moves the frame 206 downward so that the uppermost bag in the stack remains at substantially the predetermined delivery height. Meanwhile, the downward movement of the frame 206 causes the cam follower 218 to engage with the sloped cam surface 232. As the frame 206 continues to move downward, the cam follower 218 traverses down a portion of the sloped cam surface 232, causing the lever 216 to pivot in a clockwise direction (relative to the frame of reference of the drawings), as shown in FIG. 5. As the lever 216 pivots, it pulls (via the pivot block 212 and the reciprocating members 210) the second support surface 204 downward a distance relative to the first support surface 202 against the upward biasing of the springs 214. In this way, the surface supporting the relatively thick portion of the stack is lowered to a greater extent than the surface supporting the relatively thin portion of the stack, thereby maintaining the uppermost bag in the stack in a substantially horizontal orientation.

After a predetermined number of bags has been stacked on the stacking table 200, the count fingers (not shown) are deployed to separate the stack just formed from the continuous stream of bags. In the meantime, the frame 206 continues to move downward. By now, the cam follower 218 has completely traversed the sloped cam surface 232, and is moving down a vertical surface 234 of the cam plate 226. Thus, the lever 216 is held in a pivoted position, and both the first and second support surfaces 202, 204 move downward at the same rate. When the frame 206 has dropped to a predetermined level, a known transfer mechanism (not shown) removes the stack from the stacking table 200, folds the stack in half, and deposits the stack in a box.

After the stack is removed, the frame 206 begins to move upward. As the frame 206 moves upward, the spring 214 biases the second support surface 204 upward relative to the first support surface 202. This causes the lever 216 to pivot counterclockwise (relative to the frame of reference of the drawings). Once the pivot block 212 abuts the underside of the frame 206, the second support surface 204 remains substantially horizontally aligned with the first support surface 202, and the count fingers pass through the slots 102 in the stacking table 200, depositing on the stacking table 200 the first few bags of the next stack. The process then repeats.

As noted above, the cam plate 226 can be manually repositioned on the cross bar 228 by using the adjustable screw assembly 230. By moving the cam plate 226 away from the pivot block 212 (to the left in FIG. 4), the cam follower 218 will be aligned with a point lower and farther to the right on the sloped cam surface 232. Thus, as the frame 206 moves downward, the cam follower 218 will contact the cam surface 232 later and will traverse less of the sloped cam surface 232 than it would if the cam plate 226 were positioned as shown in FIG. 4. Consequently, the lever 216 will pivot to a lesser extent, and the distance that the second support surface 204 is displaced relative to the first support surface 202 will be smaller.

Conversely, by moving the cam plate 226 toward the pivot block 212 (to the right in FIG. 4), the cam follower 218 will be aligned with a point higher and farther to the left on the sloped cam surface 232. Thus, as the frame 206 moves downward, the cam follower 218 will contact the cam surface 232 earlier and will traverse more of the sloped cam surface 232 than it would if the cam plate 226 were positioned as shown in FIG. 4. Consequently, the lever 216 will pivot to a greater extent, and the distance that the second support surface 204 is displaced relative to the first support surface 202 will be greater.

A significant advantage of this embodiment of the present invention is that the cam plate 226 can be positionally adjusted while the stacking apparatus 100 is operating. In this way, the operator can adjust the displacement of the second support surface 204 relative to the first support surface 202 as necessary, without having to replace any parts or shut down the stacking apparatus 100. Additionally, a single apparatus can be used for forming stacks consisting of a different number of bags, simply by repositioning the cam plate 226.

Those of ordinary skill in the art will understand that the slope of the cam surface 232 determines the rate at which the second support surface 204 is displaced relative to the first support surface 202. Increasing the slope (i.e., making it closer to vertical) decreases the rate of downward displacement of the second support surface 204 relative to the first support surface 202. Decreasing the slope (i.e., making it closer to horizontal) increases the rate of downward displacement of the second support surface 204 relative to the first support surface 202. Thus, cam plates having cam surfaces with different slopes can be easily interchanged to effect different relative displacement rates to meet different operational demands. Alternatively, a single cam plate could be designed with varying slopes or could be pivotally mounted on the cross bar so that the angle of the sloped cam surface could be varied simply by pivoting the cam plate. This is particularly advantageous, for example, when switching between different types of articles, such as between bags having different thicknesses, or between zipper bags and slider bags. Slider bags have a thicker profile, and consequently require not only a greater total differential drop, but also a greater rate of drop.

Figure 6:
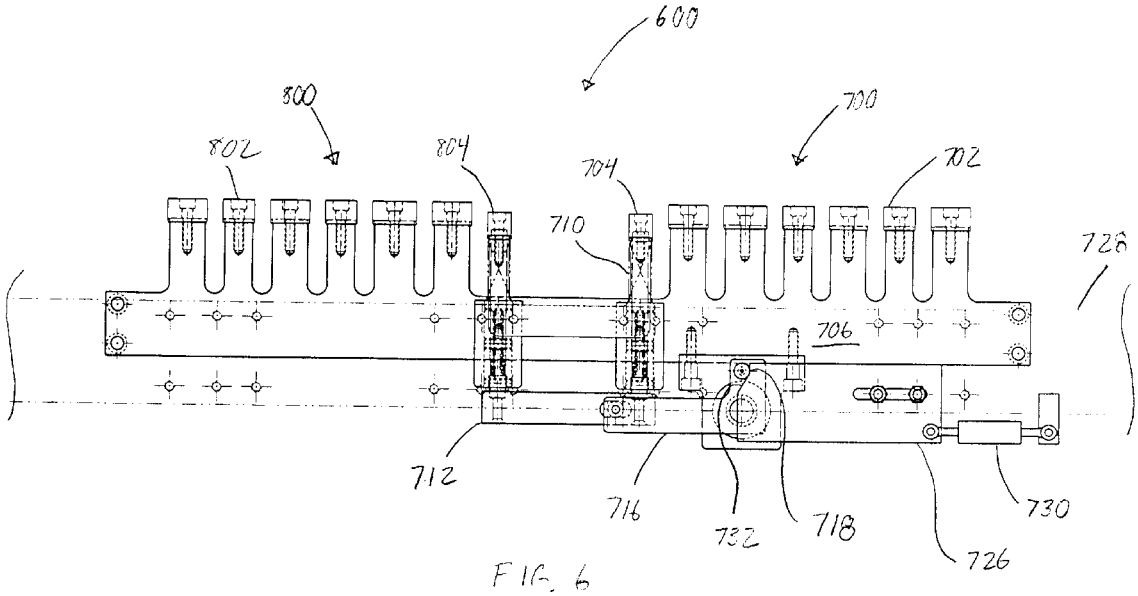
FIG. 6 is a schematic elevational view of another preferred embodiment of a stacking apparatus according to the present invention.
Figure 7:
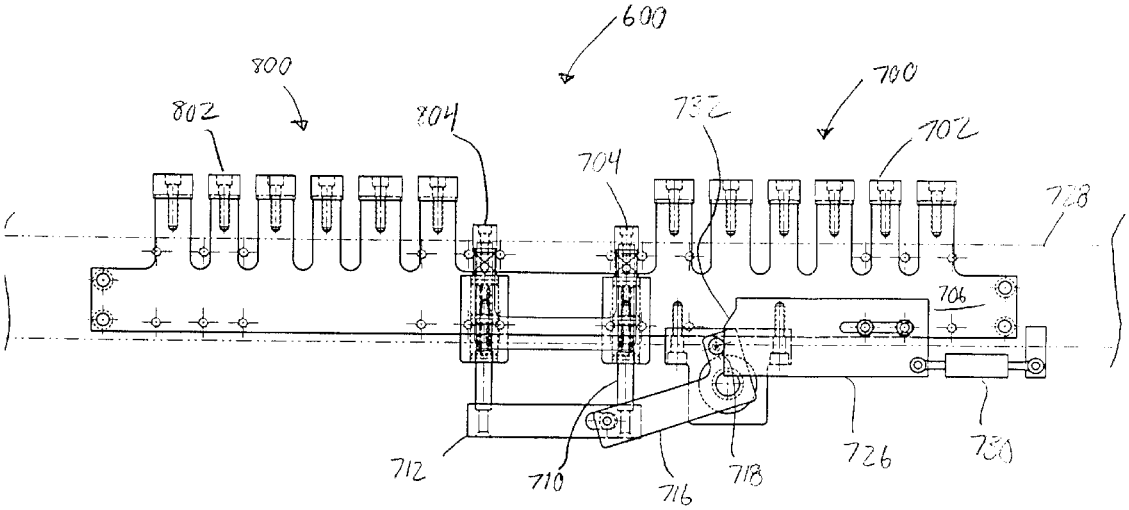
FIG. 7 is a schematic elevational view of the stacking apparatus shown in FIG. 6, wherein the support surfaces of the stacking table are displaced relative to one another.

Another embodiment of a stacking apparatus according to the present invention is illustrated in FIGS. 6 and 7. The stacking apparatus 600 shown in FIGS. 6 and 7 is substantially the same as the embodiment discussed above, and similar parts have been given reference numerals that end in the same two digits. A detailed discussion of most of these features is unnecessary here. The primary distinctions of this embodiment over the foregoing embodiment are that the orientation of the stacking tables 700, 800 is reversed, with the second support surfaces 704, 804 for the relatively thick portions of the bags facing inwardly, and a single cam and lever arrangement is used to vertically reciprocate the second support surfaces 704, 804 relative to the first support surfaces 702, 802. Otherwise, the operation of this embodiment is substantially similar to that discussed above.

The embodiments discussed above are representative of embodiments of the present invention and are provided for illustrative purposes only. They are not intended to limit the scope of the present invention. Although components, materials, configurations, and means of connecting various parts have been shown and described, such are not limiting. Modifications and variations are contemplated within the scope of the present invention, which is intended to be limited only by the scope of the accompanying claims.

INDUSTRIAL APPLICABILITY

The apparatus and method of the present invention are suited for use in stacking articles of non-uniform thickness, and are particularly useful in stacking in connection with the mass production and packaging of plastic zipper bags and the like. The thicker and thinner ends of the articles are stacked on separately movable support surfaces. As the articles are stacked, the support surfaces descend by different amounts to maintain the uppermost article in the stack in a substantially horizontal orientation.

We claim:

1. A bag stacking apparatus comprising:

a stacking table for receiving a plurality of articles, the stacking table including separately movable first and second portions;

means for moving the stacking table through a range of motion;

means for displacing the second portion of the stacking table relative to the first portion of the stacking table in response to movement of the stacking table through the range of motion by the moving means; and means for adjusting a relative distance by which the displacing means displaces the second portion of the stacking table relative to the first portion of the stacking table.

2. A bag stacking apparatus according to claim 1, wherein the adjustment means adjusts the relative distance while the stacking table is being moved through the range of motion.

3. A bag stacking apparatus according to claim 1, wherein the displacing means comprises:

a cam plate relative to which the stacking table is moved by the moving means; and a cam follower mechanically coupled to the second portion of the stacking table and selectively engageable with the cam plate.

4. A bag stacking apparatus according to claim 3, wherein the displacing means further comprises:

a pivotable lever on which the cam follower is mounted; and a reciprocating member coupled between the pivotable lever and the second portion of the stacking table, wherein the cam follower is mechanically coupled to the second portion of the stacking table via the lever and the reciprocating member.

5. A bag stacking apparatus according to claim 3, wherein the cam plate has a cam surface for engagement with the cam follower, the cam surface being sloped relative to a direction in which the moving means moves the stacking table.

6. A stacking apparatus comprising:

a stacking table for receiving a plurality of articles, the stacking table including separately movable first and second portions;

means for moving the stacking table through a range of motion; and means for displacing the second portion of the stacking table relative to the first portion of the stacking table in response to movement of the stacking table through the range of motion by the moving means.

7. A stacking apparatus according to claim 6, wherein the displacing means comprises:

a cam plate relative to which the stacking table is moved by the moving means; and a cam follower mechanically coupled to the second portion of the stacking table and selectively engageable with the cam plate.

8. A stacking apparatus according to claim 7, wherein the displacing means further comprises:

a pivotable lever on which the cam follower is mounted; and a reciprocating member coupled between the pivotable lever and the second portion of the stacking table, wherein the cam follower is mechanically coupled to the second portion of the stacking table via the lever and the reciprocating member.

9. A stacking apparatus according to claim 7, wherein the cam plate has a cam surface for engagement with the cam follower, the cam surface being sloped relative to a direction in which the moving means moves the stacking table.

10. A stacking apparatus according to claim 6, further comprising means for adjusting a relative distance by which the displacing means displaces the second portion of the stacking table relative to the first portion of the stacking table.

11. A stacking apparatus comprising:

a stacking table including separately movable first and second support surfaces;

a selectively stationary cam plate having a cam surface;

an actuator for moving the stacking table through a range of motion relative to the cam plate; and a cam follower mechanically coupled to the second support surface and located to engage the cam surface when the stacking table is moved through at least part of the range of motion, so that when the actuator moves the stacking table and the cam follower engages the cam surface, the second support surface is displaced relative to the first support surface.

12. A stacking apparatus according to claim 11, wherein the cam plate is repositionable to vary a relative distance by which the second support surface is displaced relative to the first support surface when the stacking table is moved through the range of motion.

13. A stacking apparatus according to claim 12, wherein the cam plate can be repositioned while the stacking table is being moved through the range of motion.

14. A stacking apparatus according to claim 11, wherein the cam surface with which the cam follower engages is sloped relative to a direction in which the actuator moves the stacking table.

15. A stacking apparatus according to claim 11, wherein the cam surface has a slope that determines the rate at which the second support surface is displaced relative to the first support surface when the stacking table is moved through the range of motion.

16. A stacking apparatus according to claim 11, further comprising:

a lever on which the cam follower is mounted, the lever being pivotally connected relative to the first support surface; and a reciprocating member coupling the lever to the second support surface.

17. A stacking apparatus according to claim 11, wherein the stacking apparatus receives a plurality of articles which are stacked sequentially on one another on the stacking table, and the second support surface is displaced relative to the first support surface to maintain the uppermost article in a substantially horizontal orientation as the articles are stacked.

18. A stacking apparatus according to claim 17, wherein the actuator moves the delivery table to maintain the uppermost article at a substantially constant height relative to the cam plate.

19. A stacking method comprising the steps of:

delivering a plurality of articles sequentially to a stacking table at a delivery height, the stacking table including a first support surface and a second support surface;

lowering the stacking table relative to the delivery height so that each subsequent article delivered to the stacking table is stacked on top of a previous article at substantially the delivery height; and simultaneously with the lowering step and responsive to the lowering of the stacking table, downwardly displacing the second support surface relative to the first support surface.

20. A stacking method according to claim 19, further comprising the step of adjusting a vertical distance by which the second support surface is displaced relative to the first support surface.

21. A stacking method according to claim 20, wherein the adjusting step can be executed simultaneously with the lowering step.

22. An apparatus for stacking sequentially a plurality of articles, the articles each having a relatively thin portion and a relatively thick portion, the apparatus comprising:

a stacking table for receiving the plurality of articles, the stacking table including a first support surface for supporting the relatively thin portion of the articles and a second support surface for supporting the relatively thick portion of the articles;

a cam plate having a cam surface;

an actuator coupled to the stacking table for moving the stacking table through a range of motion relative to the cam plate; and a lever pivotally mounted relative to the stacking table and linked to the second support surface, the lever having a cam follower connected thereto so that as the stacking table is moved through at least part of the range of motion, the cam follower engages the cam surface, thereby pivoting the lever to displace the second support surface relative to the first support surface.

23. An apparatus according to claim 22, further comprising a frame on which the first support surface is mounted, the frame having a bore formed therethrough.

24. An apparatus according to claim 23, further comprising a reciprocating assembly including:

an elongated member coupled at one end to the second support surface, with the other end extending through the bore in the frame; and a pivot block pivotally coupling the lever to the other end of the elongated member.

25. An apparatus according to claim 22, wherein the cam plate is positionally adjustable to vary a relative distance by which the second support surface is displaced relative to the first support surface when the stacking table is moved through the range of motion.

26. An apparatus according to claim 25, wherein the cam plate can be adjusted while the actuator is moving the stacking table through the range of motion.

27. An apparatus according to claim 22, wherein the cam surface has a slope that determines the rate at which the second support surface is displaced relative to the first support surface when the stacking table is moved through the range of motion.

28. An apparatus according to claim 22, wherein each subsequent article is stacked on top of a previous article on the stacking table at a substantially constant height relative to the cam plate.

29. An apparatus according to claim 22, wherein each subsequent article is stacked on top of a previous article on the stacking table in a substantially horizontal orientation.

30. A bag stacking method comprising the steps of:

delivering a continuous stream of articles sequentially to a stacking table at a delivery height, the articles each having a relatively thin portion and a relatively thick portion, the stacking table including a first support surface for supporting the relatively thin portion of the articles and a second support surface for supporting the relatively thick portion of the articles, wherein a spring biases the second support surface upward into horizontal alignment with the first support surface;

lowering the stacking table relative to the delivery height, so that each subsequent article is stacked on top of a previous article at substantially the delivery height; and downwardly displacing the second support surface a vertical distance relative to the first support surface against the upward biasing of the spring, such that the uppermost article in the stack is maintained in a substantially horizontal orientation, wherein the lowering of the stacking table drives the downward displacement of the second support surface relative to the first support surface.

31. A bag stacking method according to claim 30, further comprising the step of adjusting the vertical distance by which the second support surface is displaced relative to the first support surface.

32. A bag stacking method according to claim 31, wherein the adjusting step can be executed simultaneously with the lowering step.

33. A bag stacking method according to claim 30, wherein the displacing step is executed simultaneously with the lowering step.

34. A stacking apparatus comprising:

a stacking table for receiving a plurality of flexible articles, each article having a non-uniform thickness, the stacking table including separately movable first and second support surfaces;

a frame on which the first support surface is mounted;

an elongated reciprocating member coupled to the second support surface;

a spring for biasing the second support surface upward relative to the frame;

a lever comprising two arms disposed at an angle relative to one another, the lever being pivotally coupled to the frame near an intersection of the two arms of the lever, the lever having a cam follower mounted on one arm thereof, and the lever being pivotally coupled to the reciprocating member at the other arm thereof;

a selectively stationary cam plate having a cam surface for engagement with the cam follower; and an actuator coupled to the stacking table for moving the stacking table downward relative to the cam plate, wherein as the actuator moves the stacking table downward, the cam follower engages the cam surface, causing the lever to pivot so as to displace the second support surface downward relative to the first support surface against the upward biasing of the spring.

35. A stacking apparatus according to claim 34, wherein the frame includes a vertical bore through which the reciprocating member extends.

36. A stacking apparatus according to claim 35, wherein the reciprocating member is coupled to an underside of the second support surface.

37. A stacking apparatus according to claim 36, wherein the spring is disposed about the reciprocating member between the underside of the second support surface and an upper portion of the frame.

38. A stacking apparatus according to claim 34, further comprising a pivot block coupling the lever to the reciprocating member.

39. A stacking apparatus according to claim 34, wherein each subsequent article is stacked on top of a previous article on the stacking table at a substantially constant height relative to the cam plate.

40. A stacking apparatus according to claim 34, wherein each subsequent article is stacked on top of a previous article on the stacking table in a substantially horizontal orientation.

41. A stacking apparatus according to claim 34, wherein the cam plate is repositionable to vary a distance by which the second support surface is displaced relative to the first support surface when the stacking table is moved downward.

42. A stacking apparatus according to claim 41, wherein the stationary cam plate can be repositioned while the stacking table is being moved downward.

43. A stacking apparatus according to claim 34, wherein the cam plate is positionally adjustable to vary a portion of the cam surface engaged by the cam follower when the stacking table is moved downward.

44. A stacking apparatus according to claim 34, wherein a vertical distance by which the second support surface is displaced relative to the first support surface can be adjusted while the stacking table is being moved downward.

45. A stacking apparatus according to claim 34, wherein the cam surface has a slope that determines the rate at which the second support surface is displaced relative to the first support surface when the stacking table is moved downward.

46. A bag stacking apparatus comprising:

a stacking table for receiving a plurality of articles, the stacking table including separately movable first and second portions;

means for moving the stacking table through a range of motion;

means for displacing the second portion of the stacking table relative to the first portion of the stacking table as the stacking table is moved through the range of motion; and means for adjusting a relative distance by which the displacing means displaces the second portion of the stacking table relative to the first portion of the stacking table, wherein the displacement of the second portion of the stacking table relative to the first portion is independent of the weight of the articles stacked on the stacking table.

47. A bag stacking apparatus according to claim 46, wherein the adjustment means adjusts the relative distance while the stacking table is being moved through the range of motion.

48. A bag stacking apparatus according to claim 46, wherein the displacing means comprises:

a cam plate relative to which the stacking table is moved by the moving means; and a cam follower mechanically coupled to the second portion of the stacking table and selectively engageable with the cam plate.

49. A bag stacking apparatus according to claim 48, wherein the displacing means further comprises:

a pivotable lever on which the cam follower is mounted; and a reciprocating member coupled between the pivotable lever and the second portion of the stacking table, wherein the cam follower is mechanically coupled to the second portion of the stacking table via the lever and the reciprocating member.

50. A bag stacking apparatus according to claim 48, wherein the cam plate has a cam surface for engagement with the cam follower, the cam surface being sloped relative to a direction in which the moving means moves the stacking table.

51. A bag stacking method comprising the steps of:

delivering a continuous stream of articles sequentially to a stacking table at a delivery height, the articles each having a relatively thin portion and a relatively thick portion, the stacking table including a first support surface for supporting the relatively thin portion of the articles and a second support surface for supporting the relatively thick portion of the articles, wherein a spring biases the second support surface upward into horizontal alignment with the first support surface;

lowering the stacking table relative to the delivery height, so that each subsequent article is stacked on top of a previous article at substantially the delivery height; and downwardly displacing the second support surface a vertical distance relative to the first support surface against the upward biasing of the spring, such that the uppermost article in the stack is maintained in a substantially horizontal orientation, wherein the vertical distance that the second support surface is displaced relative to the first support surface is independent of the weight of the articles stacked on the stacking table.

52. A bag stacking method according to claim 51, further comprising the step of adjusting the vertical distance by which the second support surface is displaced relative to the first support surface.

53. A bag stacking method according to claim 52, wherein the adjusting step can be executed simultaneously with the lowering step.

54. A bag stacking method according to claim 51, wherein the displacing step is executed simultaneously with the lowering step.

* * * * *